US011192040B2

(12) United States Patent
Marsik

(10) Patent No.: US 11,192,040 B2
(45) Date of Patent: Dec. 7, 2021

(54) FREE FALL SIMULATOR COOLING SYSTEM

(71) Applicant: STROJIRNA LITVINOV SPOL. S.R.O., Litvinov (CZ)

(72) Inventor: Tomas Marsik, Litvinov (CZ)

(73) Assignee: STROJIRNA LITVINOV SPOL. S.R.O, Litvinov (CZ)

( * ) Notice: Subject to any disclaimer, the term of this patent is extended or adjusted under 35 U.S.C. 154(b) by 0 days.

(21) Appl. No.: 16/634,817

(22) PCT Filed: Jul. 26, 2018

(86) PCT No.: PCT/IB2018/000882
§ 371 (c)(1),
(2) Date: Jan. 28, 2020

(87) PCT Pub. No.: WO2019/021056
PCT Pub. Date: Jan. 31, 2019

(65) Prior Publication Data

US 2021/0113933 A1 Apr. 22, 2021

(30) Foreign Application Priority Data

Jul. 28, 2017 (CZ) ..... CZ2017-433

(51) Int. Cl.
*A63G 31/00* (2006.01)
*F24F 1/0059* (2019.01)

(52) U.S. Cl.
CPC ..... *A63G 31/00* (2013.01); *F24F 1/0059* (2013.01); *A63G 2031/002* (2013.01)

(58) Field of Classification Search
CPC ... A63G 31/00; A63G 2031/005; G01M 9/04; B64D 23/00
(Continued)

(56) References Cited

U.S. PATENT DOCUMENTS 6,083,110 A 7/2000 Kitchen et al.
8,668,497 B2 3/2014 Nebe et al.
(Continued)

FOREIGN PATENT DOCUMENTS

EP 2488265 B1 8/2018
JP H08299515 A 11/1996
(Continued)

OTHER PUBLICATIONS

International Search Report, related to Application No. PCT/IB2018/000882 dated Nov. 6, 2018.

*Primary Examiner* — Kien T Nguyen
(74) *Attorney, Agent, or Firm* — von Briesen & Roper, s.c.

(57) ABSTRACT

A free fall simulator comprising: a wind tunnel system; a flight chamber connected to the wind tunnel allowing for a continuous flow of circulating air, and a cooling system for cooling of the air circulating in the wind tunnel system, wherein the cooling system comprises: an air inlet sucking in a part of the air circulating in the wind tunnel system; at least one heat exchanger comprising a coolant; and at least one air outlet adapted such that the cooled air leaves the cooling system through the at least one air outlet. The cooling system further comprises: a closed pressure chamber comprising a cooling area having pressure higher than atmospheric pressure, and at least one auxiliary fan. The at least one heat exchanger is located inside of the closed pressure chamber so that the cooling of the circulating air takes place in the cooling area.

10 Claims, 4 Drawing Sheets

(58) Field of Classification Search
USPC ..... 472/49–50, 68, 136–137; 434/247, 258; 73/147
See application file for complete search history.

(56) References Cited

U.S. PATENT DOCUMENTS

| | | | | |
|---|---|---|---|---|
| 2004/0115593 | A1 | 6/2004 | Hatlestad et al. | |
| 2006/0025227 | A1 | 2/2006 | Metni et al. | |
| 2009/0158835 | A1* | 6/2009 | Pellicer | G01M 9/02 73/147 |
| 2011/0165545 | A1* | 7/2011 | Nebe | A63G 31/00 434/247 |
| 2017/0234764 | A1* | 8/2017 | Westman | A63G 31/16 73/147 |

FOREIGN PATENT DOCUMENTS

| | | | |
|---|---|---|---|
| JP | H10156047 | A | 6/1998 |
| WO | WO 2004022427 | A1 | 3/2004 |
| WO | 2006012647 | A2 | 2/2006 |
| WO | 2010028980 | A1 | 3/2010 |
| WO | WO 2015185124 | A1 | 12/2015 |
| WO | WO 2017122141 | A1 | 7/2017 |

* cited by examiner

FREE FALL SIMULATOR COOLING SYSTEM

CROSS-REFERENCE TO RELATED APPLICATION

This Application is a 35 USC § 371 US National Stage filing of International Application No. PCT/IB2018/000882 filed on Jul. 26, 2018 and claims priority under the Paris Convention to Czech Patent Application No. PV 2017-433 filed on Jul. 28, 2017.

FIELD OF THE DISCLOSURE

This invention focuses on improving existing free fall simulators, in particular on improvements in the circulating air cooling system of the simulator.

BACKGROUND

Similar free fall simulators, on which this invention expands, are already described, in the Czech utility model No. 2009-21805. These modern systems utilize an advantageous shape of the wind tunnel system in combination with an advantageous placement of the fans and they, and already disclose certain advantages connected to the use of an internal cooling system located inside the wind tunnel system.

Further development in the field of free fall simulators has shown that despite the increased effectiveness of the above explained known free fall simulation systems there are still certain drawbacks, which could be addressed in order to achieve a free fall simulator offering higher comfort for a user as well as offering easier simulator integration into the surrounding building complexes, where they are installed. The below described technical modifications increase cooling efficiency, support the operation of the simulator as a whole, and improve access to the simulator structure and make maintenance easier.

A free fall simulator operates on the principle of circulating air which, when the simulator is running, counteracts gravity and causes the user of the simulator to float in the simulator flight chamber. In open simulators the air is sucked in from under the flight chamber, directly from the atmosphere, it flows through a wind tunnel and is exhausted back into the atmosphere above the flight chamber. In closed free fall simulators, during the entire time of operation, the same air circulates. The air travels and is guided by the wind tunnel system, creating a closed cyclic flow of the air. The air that circulates within such a free fall simulator is always in contact with the walls of the wind tunnel system and thus, after a certain period of operation of the simulator, the air heats up, typically through friction.

This heated-up air can be cooled either using open cooling systems (passive cooling systems), where a part of the circulating air leaves the wind tunnel and is released into the atmosphere, while a portion of air is sucked from the atmosphere back into the cyclic wind tunnel system. Mixing the circulating air with the atmospheric air regulates temperature. Other simulators use cooling systems integrated in the wind tunnels, these are independent on the outer environment and they thus operate as closed cooling systems (active cooling systems).

The free fall simulator cooling system which is integrated in the wind tunnel system is normally located in a separate duct (stream duct), which forms a bypass channel, separate from the main air stream. In such a simulator some of the circulating air flows through the stream duct, the air is cooled in the stream duct and subsequently released back into the main air stream. The cooling system typically comprises the already mentioned stream duct (bypass). Behind the inlet duct of the stream duct, an auxiliary fan is located, which supports the airflow through the cooling system. Further behind the inlet duct, a water-air-type heat exchanger connected to a cold generator is located. The heat exchanger can be located in an outlet duct, which directs the cooled air stream directly under the flight chamber. The heat exchanger can be in the shape of a cooler similar to that of a car, though of a much larger size, and through this exchanger a part of the air circulating in the wind tunnel system is passed. The air passing through the heat exchanger comes into contact with the cooling medium (e.g. water circulating in the heat exchanger), whereafter it travels back into the wind tunnel system, where it is mixed with the rest of the circulating air, thereby cooling it down.

Drawbacks of the current heat exchangers located in the wind tunnel system are the following. First, due to the sudden contact of the hot air with the cooling medium, the development of small water condensate droplets has been observed, these droplets are carried away by the air stream and get through into the flight chamber, where they sometimes can cause, even significant, discomfort to the simulator users. Users typically wear protective glasses, on which the generated water droplets splash, distracting users and taking away from their overall flight experience. Condensate droplets splashing onto unprotected parts of the simulator users' faces also causes significant discomfort.

Another discomfort users can experience in the above described systems is the development of a cold air stream in the simulator wind tunnel system, which has a significantly lower temperature than the surrounding air. This effect is created by the cooled air thrust from the cooling system being released in a concentrated stream, close to the flight chamber and directly in the direction of the flight chamber, causing it to mix insufficiently with the rest of the circulating air. In particular, it happens that the cooled air reaches the flight chamber, so the users in the flight chamber can perceive streams of unmixed cool air.

Apart from that, the operation of the cooling system (in particular the auxiliary fan and the air streaming through the heat exchanger), aggravated by the cooling system ducts, acts as a noise generator in the simulator, due to the concentrated expulsion of the cooling system at the lower edge of the nozzle under the flight chamber, and the noise protrudes into the flight chamber and thus lowers the comfort of users.

Therefore, the present invention focuses on mitigating the above described drawbacks, thus increasing the comfort of the persons using the free fall simulator who are flying. Accordingly, the free fall simulator of the present invention is provided with the below technical features.

SUMMARY OF THE INVENTION DISCLOSURE

In order to eliminate the above listed drawbacks of the existing simulators and their cooling systems and in order to even further improve experience for free fall simulator users, the free fall simulator according to the present invention is constructed such that the free fall simulator comprises a wind tunnel system, a flight chamber connected to the wind tunnel system such that the wind tunnel system and the flight chamber allow for a continuous flow of circulating air, and a cooling system for cooling of the air circulating in the wind tunnel system. The cooling system comprises an air inlet sucking in a part of the air circulating in the wind tunnel system, at least one heat exchanger comprising a coolant, and at least air outlet adapted such that cooled air leaves the cooling system through the at least one air outlet.

The cooling system further comprises a closed pressure chamber comprising a cooling area, wherein pressure in said cooling area is higher than atmospheric pressure, and at least one auxiliary fan configured to maintain pressure within the cooling area of the pressure chamber higher than the atmospheric pressure. Said at least one heat exchanger is located inside of the closed pressure chamber so that the cooling of the circulating air takes place in the cooling area.

With the structure of the new simulator and cooling system as defined above, the following advantageous effects have been observed. Firstly, all of the condensate is captured in the cooling area, thus preventing the carrying away of the condensate droplets into the flight chamber and preventing their contact with users. Specifically, in the above defined configuration, most of the condensate is captured in the pressure chamber. Secondly, more efficient mixing of the cooled air with the rest of the circulating air of the wind tunnel system is achieved. The cooling area formed by the closed pressure chamber captures the cooled air immediately after the air leaves the heat exchanger. Thanks to the presence of the above defined pressure chamber the cooled air is not released into the wind tunnel system in a concentrated stream, but rather more evenly, since the cooled air from the cooling area leaves through the outlet window, which ensures an evenly distributed expulsion of the cooled air. The above described system ensures better mixing of the cooled air and thus prevents the cooled air from getting into contact with users in the flight chamber. Furthermore, the pressure chamber is also suited for better shielding from the noise generated by the cooling system, e.g. by means of a special anti-noise coating of the walls of the pressure chamber. Another advantage of the above defined pressure chamber is the delimitation of a clearly defined area for carrying out maintenance, as well as easier access to the entire cooling system. This can reduce the risk of unexpected simulator down times due to necessary regular maintenance work, which can be done significantly quicker.

Another advantage is the above defined cooling system evens out and the overall improves quality of the speed profile, thereby also improving air stream quality in the flight chamber, since the expelled air revives the border layer at the walls of the wind tunnel system.

Heat that created in free fall simulators is usually exhausted into the surrounding environment, without any further use, and the amount of heat being led away is significant. For this reason, it is further disclosed in the context of present invention connecting the waste heat to suitable recuperation heat systems that are part of the building the free fall simulator is installed in, whereby enabling to save otherwise lost heat for useful purposes. Reusing waste heat by means of recuperation is impossible in open cooling systems, where the warm air from the wind tunnel system is released directly to the surrounding atmosphere.

Other advantageous embodiments of the present invention include one or more of the below listed advantageous technical features:

the free fall simulator is adapted such that the air cooled in the heat exchanger leaves the heat exchanger in the direction towards inside of the cooling area, and only then the cooled air return back from the cooling area into the wind tunnel system; an advantage of this embodiment lies in fact the it enables better mixing of the hot and cool air; moreover, the configuration of this embodiment also contributes to escaping of the condensate into the flight chamber, instead the condensate is trapped the inside the cooling area;

the closed pressure chamber comprises at least one intake window and at least one outlet window arranged such that the intake duct is located inside the intake window, and such that the cooled air leaves the cooling area through the outlet window;

the outlet of the heat exchanger is arranged such that the cooled air from the heat exchanger does not leave the heat exchanger in the direction towards any outlet window; in other words, the heat exchanger outlet of the heat exchanger is arranged such that the cooled air from the heat exchanger is outputted towards one of the walls of the pressure chamber, wherein neither of the walls towards which the cooled air is outputted comprises an outlet window; this preferred embodiment of the cooling system further enhances the desired effect of improving mixing of the warm and cold air the effect of preventing the condensate from escaping;

The outlet window of the pressure chamber has is an elongated slot that extends across one of the walls of the pressure chamber, and across the entire width of the wind tunnel system profile; this modification creates an increased effect of even air expulsion; the elongated slot of appropriate dimensions in the wall of the pressure chamber helps to achieve an even expulsion of the cooled air from within the cooling area, as well as its easy and quick mixing with the circulating main air stream of the wind tunnel;

The cooling system further includes at least one auxiliary fan and/or at least one set of inlet bending vanes; auxiliary fans facilitate the streaming of the air inside the cooling area as well as its streaming through the heat exchanger; the inlet bending vanes can be very useful, in particular for some specific shapes of the wind tunnel system; in general, these bending vanes direct the incoming hot air directly into contact with the heat exchanger and they reduce creation of undesirable turbulence at the intake of the cooling system;

The outlet window has an aerodynamic shape which directs adapted to direct the cooled air in a predetermined direction; control over the direction of the air stream in the simulator, regardless in which of its parts, is extremely important; in the case of the needs of specific simulators, this modification is desirable since it increases smoothness of the airstream, provides better mixing of warm and cold air, and reduces turbulence at the outlet from the cooling area;

The distance of the intake window from the nozzle is at least 2 meters; this further improvement of the system ensures easier air mixing thanks the placement of the outlet window in a sufficient distance from the nozzle (and consequently from the flight chamber);

the pressure chamber further includes a sealed closeable opening which can typically be used as a manhole for maintenance personnel; it is sealed and closeable to prevent cooled air from escaping through it from the cooling area;

the temperature of the air circulating in the wind tunnel system and the flight chamber is regulated by means of a closed cooling system; closed cooling systems in combination with the cooling system described show exceptionally good results with regards to cooling effectiveness and they allow reaching evenly spread temperatures within the whole wind tunnel system, without any larger temperature fluctuations, regardless of the season or of the location of the installation (allows all-year operation in tropical regions);

the cooling system is located in the lower horizontal section of the free fall simulator; this position is selected for general construction reasons; the lower part of the simulator is often situated in basement areas of buildings, what facilitates noise abatement; apart from that, the foundations of buildings are stronger and allow for an easier installation of cooling systems;

the cooling system is located before the intake of the nozzle which leads the streaming air into the flight chamber; this configuration amplifies the advantages connected to the placement of the cooling system in the lower horizontal section of the simulator even more;

the cooling system of the wind tunnel comprises at least one loop having at least one fan, wherein the cooling system is located behind said at least one fan, in the direction of the circulating airflow; in this configuration, the flow through the main fans of the wind tunnel is not directly influenced by the mixing of the warm air and the cold air from the cooling system, and thus the efficiency of the main fans is not influenced by potential turbulence and the heterogeneity of the flowing air;

the lower inner wall of the pressure chamber comprises an embedded groove that captures and collects condensed water droplets; this feature of the simulator prevents undesirable situations where the water droplets inside the cooling area are carried away by the passing air into the wind tunnel system;

The cooling system of the free fall simulator can be used for recirculation and recuperation of the waste heat from the wind tunnel in combination with all the above listed modifications which implement a closed cooling system.

Other advantageous configurations of this invention will become apparent from the below described examples of various embodiment of this invention, and from the attached drawings.

BRIEF DESCRIPTION OF THE DRAWINGS

The reference signs in the various drawings always refer to the same features or to features with the same function.

DETAILED DESCRIPTION OF THE DISCLOSURE

Figure 1:
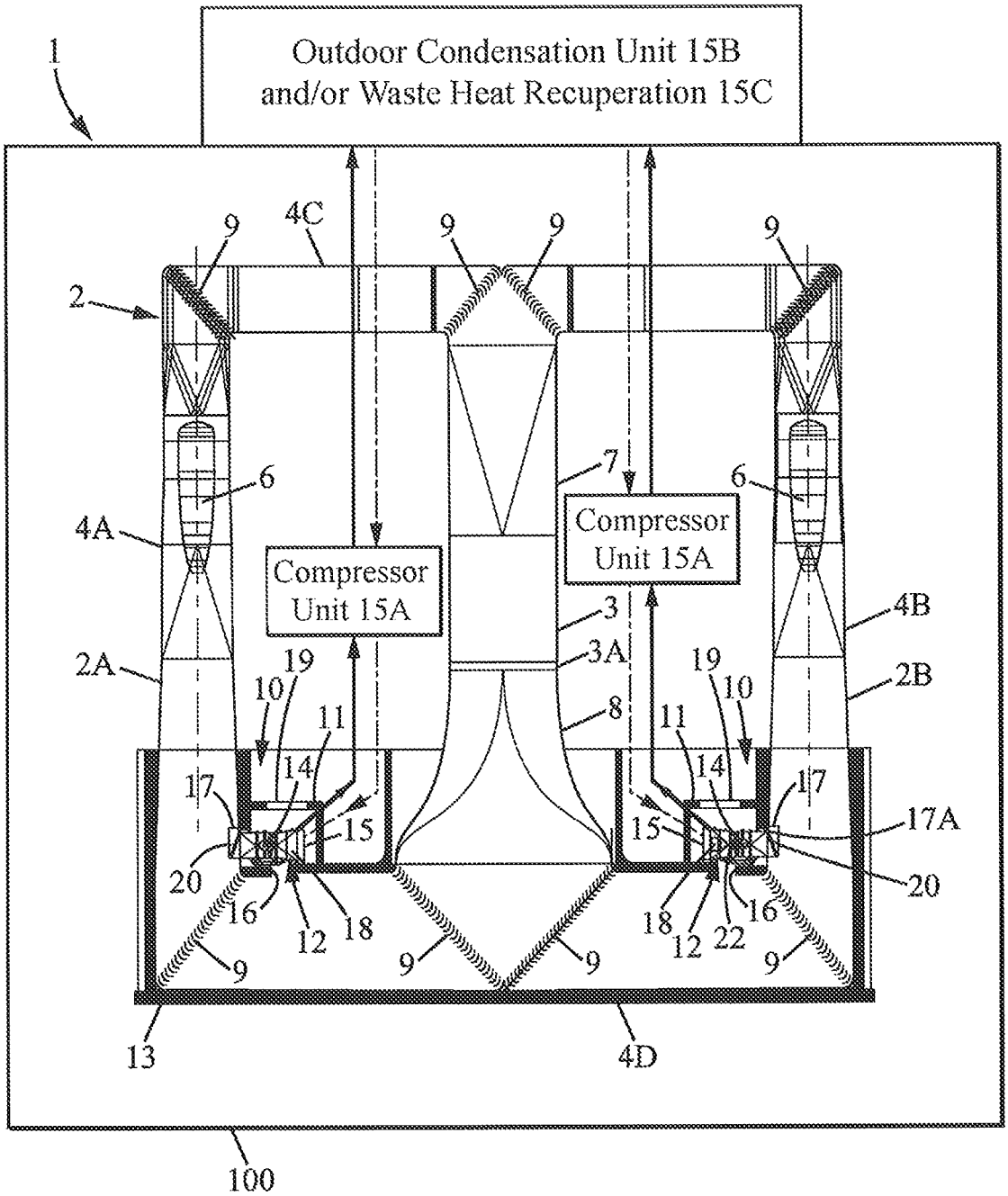
FIG. 1 is a cross-section through a free fall simulator installed in a building and including two air loops, it further shows a simplified schematic of the cooling circuit and its use for the recuperation of heat.

FIG. 1 illustrates an example of the free fall simulator 1, in accordance with the free fall simulator according to claim 1. The free fall simulator 1 is installed in building 100.

The free fall simulator according to FIG. 1 comprises a flight chamber 3 which is accessible to users of the simulator 1. At the bottom of the flight chamber 3 is installed a safety net 3A (made of metal wire for instance), which serves as the floor of the flight chamber 3. Air flows through the net 3A, from bottom to top, effecting the lifting of the user of the simulator 1 upwards, where the force of the upwards streaming air cancels out the gravitational force acting on the user.

The remaining parts of the simulator 1 that are connected to the flight chamber 3 and through which the air flows, are described as a wind tunnel system 2. Together, the wind tunnel system 2 and the flight chamber 3 then form a cyclic wind tunnel. Upwards from the flight chamber 3, in the direction of the airflow, the wind tunnel system 2 successively includes a diffuser 7, an upper horizontal section 4C, at least one vertical section 4A, 4B, a lower horizontal section 4D, and a nozzle 8. There can be more vertical sections 4A, 4B in the free fall simulator 1. FIG. 1 shows a simulator 1 with vertical sections 4A, 4B. This corresponds to the design where the wind tunnel system 2 includes two individual separate loops 2A, 2B. The first loop 2A in FIG. 1 is defined by the diffuser 7, the left part of the upper horizontal section 4C, the first vertical section 4A, the left part of the lower horizontal section 4D, and the nozzle 8. The second loop 2B in FIG. 1 is defined by the diffuser 7, the right part of the upper horizontal section 4C, the second vertical section 4B, the right part of the lower horizontal section 4D, and the nozzle 8. The wind tunnel system 2 can have any number of loops, as long as this is sensible from a design perspective. Within each loop 2A, 2B flows a part of the air that leaves the flight chamber 3, whereas the air streams from all loops join again before entering the flight chamber 3.

The loops 2A, 2B in FIG. 1 are rectangular in principle, but they can have any other shape, e.g. they can be strictly square or they can be skewed, in the form of a trapezoid. Some embodiments of the invention allow for designing the wind tunnel system 2 in the form of a triangle or using irregular shapes. In these embodiments the vertical sections 4A, 4B are usually not parallel to the vertical direction, they are rather at an acute non-zero angle with the vertical direction. The length of the vertical 4A, 4B and the horizontal 4C, 4D sections can be of any given relative proportion.

Figure 3:
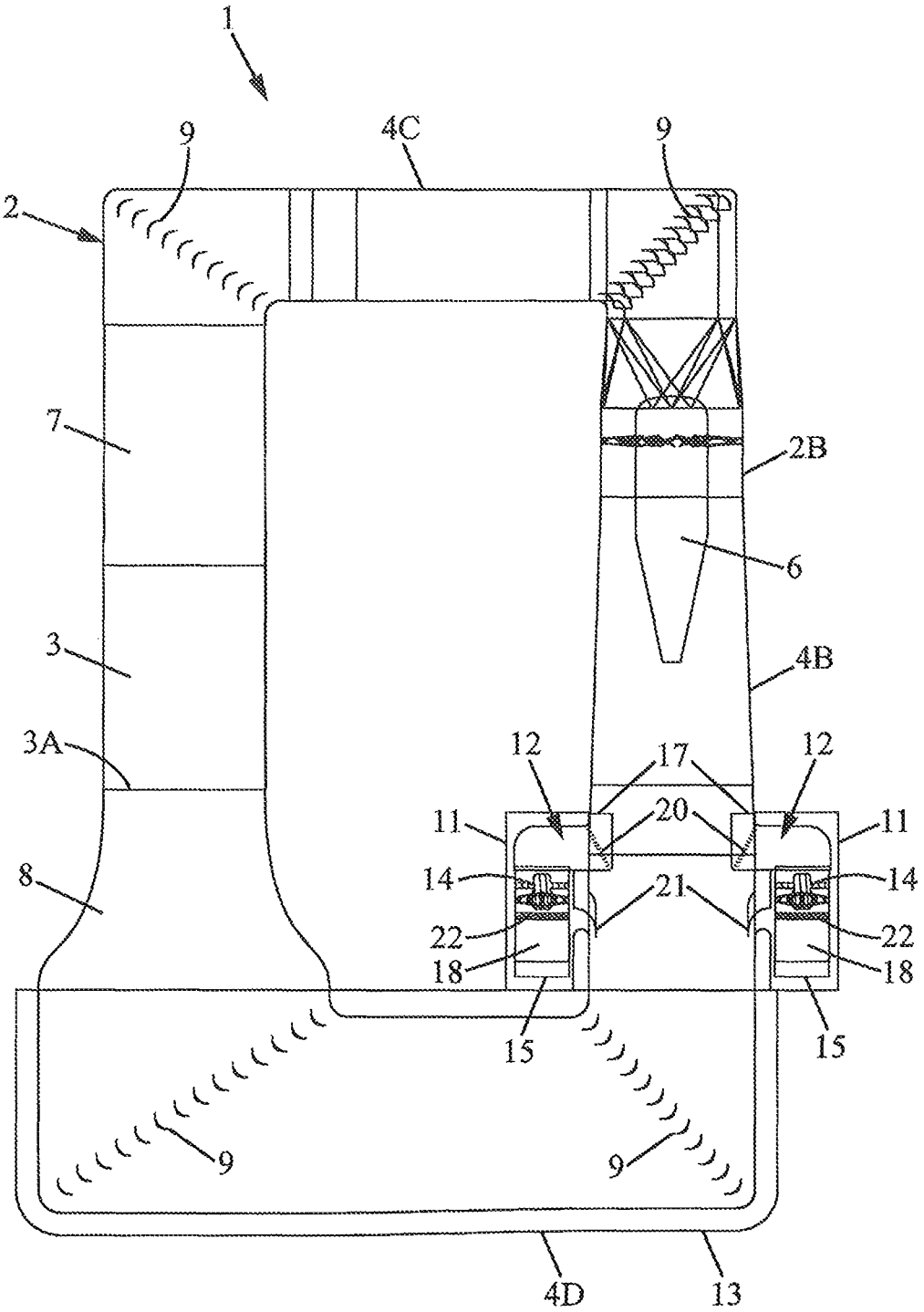
FIG. 3 is an alternative free fall simulator design that includes one air loop and where the cooling area is located in the vertical installation.

The loops 2A, 2B in FIGS. 1 and 3 are designed to contain closed cooling systems. This means that there is no air exchange with the surrounding environment. The air flowing in the loops 2A, 2B of the free fall simulator 1 is neither replenished from the surrounding atmosphere, nor is it exhausted into it, with the exception of a few perforations typically located above the flight chamber, which are there only to compensate pressure changes when starting the simulator up or shutting it down. In contrast, open cooling systems of free fall simulators are characterized by their wind tunnel system 2 having at least one opening for releasing the circulating air into the surrounding atmosphere, and at least one opening for sucking air from the surrounding atmosphere into the loop/loops of the simulator. Open cooling systems utilize air exchange with the surrounding atmosphere to regulate temperature. In contrast, closed cooling systems are fully dependent on an internal cooling system, in this specific case represented by the cooling system 11. Typically, closed systems are preferred, as they are independent of climatic conditions at the location where the free fall simulator is installed. The cooling system 11 described in this application can be used in open as well as in closed cooling systems, but closed cooling systems are preferred for their versatility and thanks to the fact that they can be used in all climatic conditions.

FIG. 3 shows a simulator 1 with an exemplary structure having only one loop 2B. This only loop 2B is again defined by the diffuser 7, the upper horizontal section 4C, the only vertical section 4B, the lower horizontal section 4D and the nozzle 8.

All the features below, described in connection with simulators 1 from FIG. 3, which have a single loop 2B, and with simulators 1 from FIG. 1, with two loops, can analogically be used in simulators with more loops.

In the cross-section perpendicular to the direction of the airflow, the diffuser 7 has an inner circular design, the radius of which gradually grows in the direction away from the flight chamber, and up to the upper horizontal section 4C of the simulator 1, where the profile is already square. In simple terms, the diffuser 7 has substantially the shape of a truncated cone, with the top surface placed on top of the flight chamber 3. The part of the diffuser 7 with the largest radius connects to the upper horizontal section 4C of the wind tunnel system 2. The diffuser 7 can also have the shape of a funnel or a cylinder. The function of the diffuser 7 is to ensure the air is distributed into the individual loops 2A, 2B of the wind tunnel system 2, and to gradually decrease the speed of the streaming. Similarly, the nozzle 8 can typically have the shape of a cone or of a funnel, with the top of the cone (funnel) being placed at the bottom of the flight chamber 3. The function of the nozzle 8 is to focus the air from the individual loops 2A, 2B back into the flight chamber 3. Due to the fact that the radius of the nozzle 8 gradually decreases in the direction of the airflow, just before the flight chamber 3, the streaming air is accelerated.

The nozzle 8 is placed under the flight chamber 3 and the diffuser 7 is placed above the flight chamber 3. An advantageous configuration is such, in which the nozzle 8, the flight chamber 3 and the diffuser 7 are arranged in a vertical line. The line defined by the nozzle 8, the flight chamber 3 and the diffuser 7 may or may not be parallel to the vertical sections of the circulation system 4A, 4B. Typically, the vertical sections 4A, 4B can be at an acute angle with the vertical direction, up to 40 degrees. In other words, in some embodiments of the invention, the vertical sections 4A, 4B do not necessarily have to be parallel with the vertical direction, but they can rather be at a non/zero acute angle with this direction.

In some embodiments of the invention, it is desirable that the diameter of the cross-section of the upper horizontal section 4C of the wind tunnel system 2, where this cross-section is taken perpendicular to the direction of the airflow, grows wider in the direction away from the diffuser 7, up to the corresponding vertical section 4A, 4B.

In the wind tunnel system 2, there are (analogically in all loops) disposed bending vanes 9, which serve to change the direction of the airflow. Typically, the bending vanes are located in the corners, i.e. where the air flows at a right or any other acute angle. In general, bending vanes can be used whenever it is necessary to change the direction of the airflow by any angle. In the invention according to FIG. 1, each loop 2A, 2B has a set of bending vanes 9 disposed between the diffuser 7 and the upper horizontal section 4C. Another set of bending vanes 9 is disposed in each loop 2A, 2B between the upper horizontal section 4C and the corresponding vertical section 4A, 4B. Another set of bending vanes 9 is located in each loop 2A, 2B at the transition between the corresponding vertical section 4A, 4B and the lower horizontal section 4D. Finally, one set of bending vanes 9 is placed in every loop 2A, 2B in the lower horizontal section 4D, just before where the air enters the nozzle 8. The number of sets of bending vanes 9 can be higher, but also lower, depending on the needs of the specific simulator 1.

Each loop 2A, 2B of the wind tunnel system 2 includes a fan 6. The fans 6 are ideally placed in the vertical section 4A, 4B of the wind tunnel system 2, where they provide the desired power, they allow for proper stabilization of pressure conditions within the simulator 1, and their noise is sufficiently isolated from the flight chamber 3. In some embodiments, it is possible to also place the fans 6 in other sections of the wind tunnel system 2. According to the embodiment of FIG. 1, each vertical section 4A, 4B is a single duct containing one fan 6. In other embodiments of the invention the duct of each (or at least one) vertical section 4A, 4B can be split into several branches (not shown in the drawings). At a certain part of the vertical section 4A, 4B, a single vertical section duct thus may split into multiple separate ducts, which are then again joined into a single vertical section 4A, 4B duct. In such a case, each branch of the vertical section 4A, 4B can comprise exactly one fan 6. This increases the number of fans 6 in the loop 2A, 2B, as well as the efficiency of the simulator 1.

In general, the lower part of the free fall simulator 1 is made from a strong construction material, typically from concrete. Specifically, the entire lower horizontal section 4D of the wind tunnel system 2 can be executed, for instance, in the form of a concrete well 13, while, apart from concrete, other suitable building materials can be used, too. The concrete walls of this well 13 can, in in some embodiments of the invention, cover even parts of the vertical sections 4A, 4B of the wind tunnel system 2, for instance 10-25% of the vertical sections 4A, 4B. Further, in the lower horizontal section 4D of the wind tunnel system 2, there is built a concrete chamber 10, which contains the cooling system 11. Here, too, the concrete chamber can be replaced by a structure from any other suitable building material.

A part of the air circulating in the wind tunnel system 2 passes through the cooling system 11 and thus it also passes through the concrete chamber 10. Therefore, for the purposes of the description of this invention, the cooling system 11, as well as the concrete chamber 10, are considered a part of the wind tunnel system 2. Typically, 1-20% of the circulating air can be diverted into the cooling system 11, typically used values are for instance 5%, 10% or 15%. In general, the amount of the air diverted into the cooling system 11 is determined by the size of the simulator 1, the power of the cooling system 11, and the climatic conditions at the site of the installation of the simulator 1, so a different ratio than the one stated is in principle possible.

As apparent from FIG. 1, the concrete chamber 10 and the cooling system are located outside the main air stream of the wind tunnel system 2, so as not to disrupt the smoothness of the airflow. The cooling system 11 and the concrete chamber 10 are located right next to the main air stream in the wind tunnel system 2. In an embodiment of the invention, the only part of the cooling system 11 which protrudes into the main air stream of the wind tunnel system 2 is the air inlet 17. The concrete chamber 10 and the cooling system 11 for instance, are placed between the nozzle 8 and the lower fourth of the vertical section 4A, 4B.

The cooling system 11 is not necessarily bound to the presence of a concrete chamber 10, according to FIG. 1. Any other construction solution is acceptable. Likewise, it is possible to place the cooling system in the upper horizontal section 4C, or in the vertical section 4A, 4B, as long as this is advantageous from an architectural standpoint. If the cooling system 11 is located in the lower horizontal section 4C, advantageous solutions are, for instance, with the cooling system 11 in the corner at the transition between the vertical section 4A, 4B and the lower horizontal section 4C (embodiment of FIG. 1), or at the intake of the nozzle 8. The position of the cooling system 11 can vary, relative to the fans 6. The cooling system can be placed before or after the fans 6, in the direction of the airflow. The advantage of having the cooling system 11 behind the fans 6, in the direction of the airflow, lies in easier directing of a part of the air into the air inlet 17, in higher smoothness of the airstream (a detailed description of the parts of the cooling system and of their functions is provided below), and in lower impact of the cooling system on the efficiency of the simulator fans.

Figure 2:
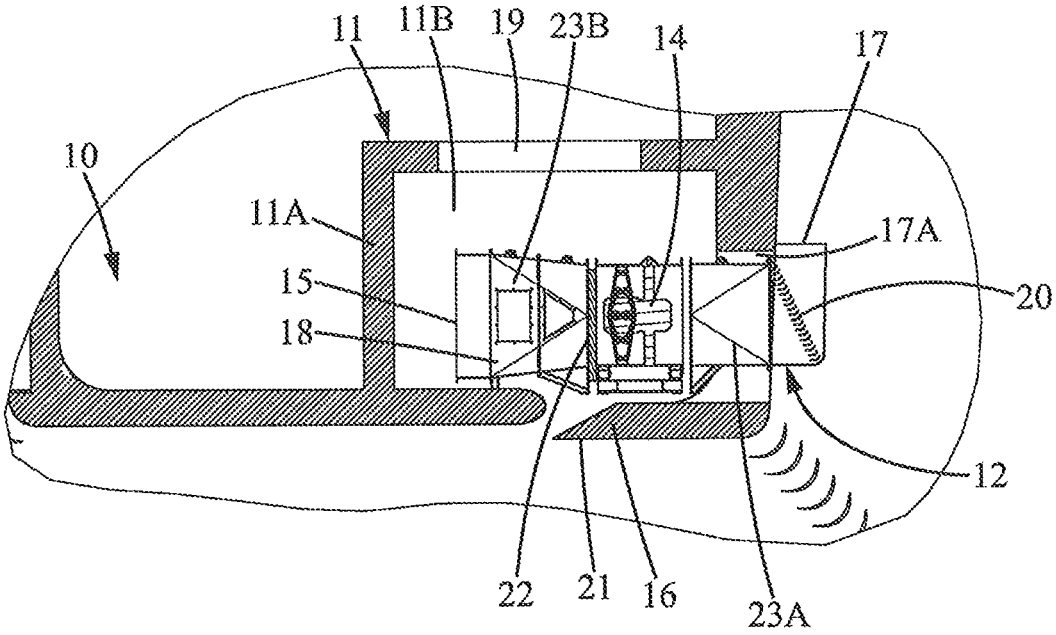
FIG. 2 is a cross-section detail of the cooling system applied in the free fall simulator described.

As is apparent from FIG. 2, the cooling system 11 is, in accordance with the claimed and described invention, defined by the closed pressure chamber 11A, which encloses the cooling area 11B for the passing through of a part of the circulating air. Placed in the pressure chamber 11A, is at least one heat exchanger 15, through which a coolant passes. The cooling of a secondary air stream, sucked in from the main air stream into the cooling system 11, then takes place in the cooling area 11B, delimited by the closed pressure chamber 11A.

The pressure chamber 11A can be made of concrete, brick, metal sheets, or it can be built from other suitable materials or their combination. The pressure chamber 11A is closed, thus it does not have any openings apart from those, which provide for a part of the air from the main air stream passing through the cooling system 11. This prevents the cooled air from escaping from the cooling area 11B. The pressure chamber 11A contains the cooling area 11B, wherein the pressure in the cooling area is higher than atmospheric pressure. Higher than atmospheric pressure conditions in the cooling area 11B are maintained by an auxiliary fan 14, which is set up to suck air in from the main air stream. The auxiliary fan 14 creates and subsequently maintains a pressure in the cooling area 11B higher than atmospheric pressure.

The pressure chamber 11A of the cooling system 11 forms a bypass of the main air stream of the circulating air, and creates an secondary air stream which is being cooled. In order to successfully direct this secondary air stream, the pressure chamber 11A includes a stream duct 12, which sucks air in from the main air stream and directs it towards the desired direction.

The air diverted into the cooling system 11 is cooled down to the required temperature and then mixed with the rest of the circulating air. To allow the air to enter the pressure chamber 11A, the pressure chamber 11A has at least one intake window 17A. In order to allow the air from the cooling system 11 back into the main air stream, the pressure chamber 11A has at least one air outlet 16. The pressure chamber 11A can have any suitable shape, e.g. cuboid, prism, or even an irregular shape, the shape of a pyramid, etc. Accordingly, the pressure chamber 11A can have any arbitrary number of walls. At least one wall of the pressure chamber 11A is in contact with the main air stream in the wind tunnel system 2. One wall of the pressure chamber 11A can have an intake window 17A (or multiple intake windows), while the air outlet 16 can be in a different wall of the concrete chamber 11A. The intake window 17A according to the embodiment of FIG. 1 is located at the end of the vertical section 4A, 4B, while the air outlet 16 is at the beginning of the lower horizontal section 4D, seen in the direction of the airflow.

The pressure chamber 11A can further include a closeable sealed opening 19, which can be used as a manhole for maintenance technicians. When the system is in operation, the closeable sealed opening 19 can be closed using a pressure lid.

A stream duct is positioned in the cooling area 11B, inside the pressure chamber 11A. The stream duct 12 can have the form of a tube through which the cooled air passes. At the beginning of the stream duct 12, there is located an air inlet 17 that sucks in the hot air from the main air stream of the wind tunnel system 2, and at the end of the stream duct 12, there is located an outlet duct 18, which expels the cooled air outside of the body of the stream duct, into the rest of the cooling area 11B. The air inlet 17 as well as the outlet duct 18 as well as the body of the stream duct 12 can be arranged in one line, or they can be curved. Likewise, the direction of the air passing through the stream duct 12 can be linear, or the air can be making a turn. When it is desirable to turn the air stream in the stream duct 12, it is advantageous to use a set of bending vanes that support a smooth change in the direction of the airflow. In the air inlet 17, in the embodiment of the invention according to FIG. 1, there are disposed intake bending vanes 20 for changing the direction of the airflow by about 90°. In the case of the embodiment of FIG. 1, the air enters the stream duct 12 when it is moving downward, and then the direction of the airflow is changed into a horizontal direction. The intake bending vanes 20 are used to secure a smooth and even airflow.

The air inlet 17 can be advantageously placed in the intake window 17A, and it can partially protrude from this window into the space of the main air stream of the wind tunnel system 2, i.e. outside of the pressure chamber 11A. The opening of the air inlet 17 can be directed against the circulating air direction, at the point where the air inlet 17 is installed.

Though the figures only show a single stream duct 12 in every cooling system 11, in various embodiments of the invention, a single cooling system 11 can include two or more stream ducts 12. For instance in FIG. 1, hidden behind the shown stream duct 12, there can be a second or third stream duct, or even more stream ducts 12 can be installed. In such a case, the pressure chamber 11A includes a corresponding number of intake windows 17A, i.e. one intake window 17A for each stream duct 12.

In the preferred configuration, a fan 14 is located within the body of the stream duct 12. In the same manner, the heat exchanger 15 is located within the body of the stream duct 12, either before, or after the auxiliary fan 14. The air inlet 17 leads a part of the circulating air from the main air stream to the heat exchanger 15, where the air is cooled. In the drawings 1-3 the heat exchanger is placed at the very end of the stream duct 12, in the outlet duct 18. Each stream duct 12 can contain a separate heat exchanger 15. An auxiliary fan 14 can be located behind the bending vanes 20. The coolant in the heat exchanger 15 can be water, or another suitable medium with a sufficient thermal capacity.

Each stream duct 12 can also include at least one cleaning sieve 22, which catches dirt particles carried by the air stream. The cleaning sieve 22 can be placed in any suitable configuration position relative to the heat exchanger 15 and the auxiliary fan 14. Optimally, the cleaning sieve can be located behind the auxiliary fan 14, in airflow direction, and before the heat exchanger 15, in order to reduce clogging of the heat exchanger by the particles carried by the air stream.

Furthermore, each stream duct 12 can include an intake diffuser 23A and/or an outlet diffuser 23B. The intake diffuser 23A has a gradually narrowing profile and it directs the incoming air towards the auxiliary fan 14, while the outlet diffuser 23B has a widening profile and it ensures an even expulsion of the air onto the heat exchanger 15.

The orientation of the body of the stream duct 12 within the wind tunnel system 2 can vary. In FIG. 1, the body of the stream duct 12 is oriented horizontally, while in FIG. 3 it is oriented vertically. As a rule, the orientation of the placement of the stream duct 12 is determined by the space available, based on the shape and the character of the building 100, in which the free fall simulator 1 is being installed. The necessary air stream direction change within the heat exchanger 12 is done by means of the mentioned bending vanes 20.

In a case, when the free fall simulator 1 includes multiple stream ducts 12, not all of the stream ducts 12 need to be entirely identical. E.g. one stream duct 12 can contain intake bending vanes 20, while the second one does not have to contain them. The determining factors always depend on the specific needs of the required design solution of each simulator 1 that is being built.

A common drawback of the current cooling systems is the fact that at their outlet, they tend to form condensed droplets of water. This is caused by the contact of the hot air entering into the cooling system 12 with the coolant, which results in a sharp drop in air temperature, and the forming of water droplets through condensation of air humidity is then in many cases unavoidable. The forming of the water condensate at the outlet duct 18 is undesirable, as the droplets in many cases get as far as into the flight chamber 3, where they cause discomfort to the users, whereby detracting from their flying experience.

Another observed drawback is the fact that the cooled air that leaves the cooling system 11 spreads along the walls of the wind tunnel system 2, all the way into the flight chamber 3. A user can then perceive temperature differences in various parts of the flight chamber 3, for instance, they can feel warm air further from the walls of the flight chamber 3, while closer to the walls of the flight chamber 3, they can feel a cool stream of air.

The technical solution that leads to the elimination of both of the above described drawbacks lies in placing the heat exchanger 15 in the cooling area 11B inside the pressure chamber 11A, which entirely encloses the cooling area 11B and thus also the heat exchanger 15. The condensed water droplets are thus captured inside the pressure chamber 11A. Users in the flight chamber 3 are thus not hit by the water droplets carried by the air stream, and they do not perceive any significant temperature fluctuations.

An advantageous configuration of the cooling system 11 is when the cooled air that leaves the heat exchanger 15 is blown inside the cooling area 11B of the pressure chamber 11A. It is thus preferred not to have the outlet of the heat exchanger 15 oriented towards the air outlet 16. This further reinforces the above described advantages. The outlet from the heat exchanger 15 is thus spatially separated from the air outlet 16. For instance, the outlet of the heat exchanger 15 can be approximately at the center of the cooling area 11B, or the outlet of the heat exchanger 15 can be orientated towards a wall of the concrete structure 11A, which does not contain an air outlet 16.

The shape of the air outlet 16 is essentially arbitrary, but an elongated one, in the shape of an elongated slot, is preferred, for instance a slot spanning across the entire length of one wall of the concrete chamber 11A. Advantageously, the elongated slot 16 extends along the entire width of the profile of the wind tunnel system 2 at the given location. In case of need, the pressure chamber 11A can have two and more air outlets 16, for instance in the form of the mentioned elongated slots. The air outlet 16 can also be in the form of a number of small windows arranged in a row, behind one another. The elongated shape of the air outlet 16 leads to even heat exchange between the cooled air from the heat exchanger 15 and the rest of the air that circulates within the simulator 1.

The air outlet 16 can be purely in the form of a cutout in the pressure chamber 11A, or the air outlet 16 can have a suitable aerodynamic shape 21, which ensures that the outgoing cooled air is directed in a predetermined direction. At the same time, such an aerodynamic shape 21 can increase the smoothness of the air passing through. In the case of the air outlet 16 being in the form of multiple smaller windows arranged in a row, each of these can be of a suitable aerodynamic shape 21.

In some embodiments of the invention, the air outlet 16 is placed at least 2 meters away from the edge of the nozzle 8, whereby a timely and even mixing of the warm and of the cool air is secured.

One of the interior walls of the pressure chamber 11A, typically the one which is located at the bottom of the cooling area 11B, can advantageously include a groove (not depicted in the drawings), positioned so as to capture escaping condensed water droplets. This prevents the condensate from being randomly carried away by the streaming air, and thus being expelled from the pressure chamber 11A, what could, again, cause discomfort to the user of an operating simulator 1, in the flight chamber 3.

FIG. 3 shows an alternative embodiment of the free fall simulator 1, featuring several differences in comparison to the simulator in FIG. 1. Most importantly, the wind tunnel system 2 of the simulator 1 in FIG. 3 features only one loop 2B. As had been already explained, there can be any number of loops 2A, 2B, and the number is selected based on specific needs and on the size of each simulator 1. The second difference between the simulators in FIGS. 1 and 3 is the fact that in FIG. 3, the cooling systems 11 are orientated in the vertical direction. In contrast, the cooling systems 11 in FIG. 1 are orientated horizontally. As had also been explained, any orientation of the cooling systems 11 is possible, in principle. Likewise, it is possible to install the cooling systems 11 in different parts of the wind tunnel system 2, i.e. in the upper horizontal 4C, or in the vertical 4A, 4B, or in the lower horizontal 4D sections of the wind tunnel system 2. FIG. 1 illustrates one of the particularly advantageous placements of the cooling systems 11, which is in the corner at the transition between the vertical section 4A, 4B and the lower horizontal section 4D. FIG. 3 is another example of an advantageous placement of the cooling system 11 in the lower fourth of the vertical section 4A, 4B. The simulator 1 from FIG. 3 is also an example where the intake window 17A and the air outlet 16 are both in the same wall of the pressure chamber 11A.

It should be noted that FIG. 3 is more schematic and that it thus does not capture in detail the presence of the walls of the pressure chamber 11A which surround the heat exchangers 15. In this case, too, however, the pressure chamber 11A having pressure higher than atmospheric pressure is built from concrete or from other above mentioned materials.

Further, it has turned out that when using effective cooling systems 11 located inside the wind tunnel system 2, the amount of heat that is being led away from the simulator 1 is rather significant. For this reason, it turned out to be desirable for some simulators 1, to lead the waste heat from the simulator 1 into the building 100, for utility purposes. The free fall simulator 1 is thus used not only for training and recreation purposes, but also for heat recuperation purposes, which results in energy savings in building 100, where the simulator 1 is installed, thus reducing the overall costs for the standard operation of building 100.

The thermal recuperation circuit as depicted in FIG. 1, in a general and schematic manner. A more detailed depiction can be found in FIG. 4. The cooling loop of the simulator 1 comprises two separate circuits, the inner cooling circuit 30, and the outer cooling circuit 40. The inner cooling circuit 30 comprises a system of cooling pipes which contain a suitable coolant, such as e.g. water, glycol etc. The coolant of the inner cooling circuit 30 passes through the heat exchangers 15, where it absorbs heat from the warm air circulating in the wind tunnel system 2. In the heat exchanger 15, the pipes of the inner cooling circuit 30 are suitably branched out so as to create the largest possible surface coming into contact with the passing air.

Within the inner cooling circuit 30, the coolant is led from the heat exchangers 15 to the compressor unit 15A, where it transfers its heat to the outer cooling circuit 40. The outer cooling circuit 40 again comprises a system of pipes containing a cooling medium. The outer cooling circuit 40 can use oil, freon, or it can be based on another cooling medium. Within the outer cooling circuit 40, the accumulated heat is led away either directly to outdoor condensation units 15B and radiated away into the atmosphere, and/or it can be partially utilized in recuperation units 15C, as utility heat for the building 100. The outer cooling circuit 40 thus can be in contact with the thermal system of building 100 in a manner allowing for a suitable transfer of heat (e.g. for heating water). The entire cooling circuit can configured such that the recuperation circuit is utilized preferentially. In case there is no suitable use for the heat led away from the simulator, in building 100, the waste heat can be led away into the outdoor condensation unit 15B, from where the heat is released into the surrounding environment.

Figure 4:
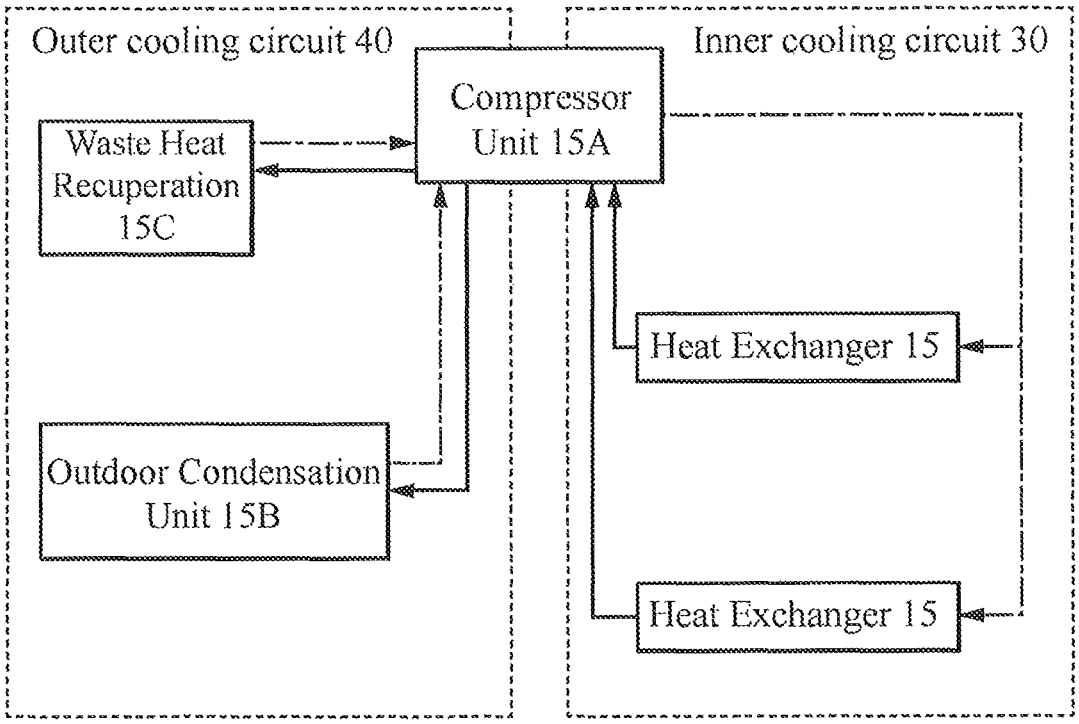
FIG. 4 is a detailed schematic of the cooling circuit which comprises an inner and an outer cooling circuit.

The dashed line in FIG. 4 and in FIG. 1 represents the cold airstream, while the full line represents the warm airstream. The dashed line in the inner cooling circuit 30 thus represents the coolant before heat from the flowing air is transferred to it, while the full line in the inner cooling circuit 30 represents the coolant after the heat has been transferred to it. Similarly, the full line in the outer cooling circuit 40 represents the cooling medium before it transfers its heat (to the environment or as part of recuperation), while the dashed line represents the cooling medium after losing the heat.

As had already been mentioned above, in the building 100, the accumulated heat can be used to heat process water or rooms. This approach is considered the most economical, as up until now, the heat from the simulator 1 has only been released into the surrounding environment, outside the building, in an uncontrolled manner. In the current systems, this uncontrolled heat release takes place both, directly, through openings in the wind tunnel system, in open cooling systems, and indirectly, in closed cooling systems, where the heat from the outdoor condensation unit 15B is freely released into the environment. One of the advantages of the disclosed technical solution is thus the option of adding a recuperation unit 15C into the outer cooling circuit 40, and partially utilizing the waste heat.

The invention claimed is:

1. A free fall simulator comprising:

a wind tunnel system;

a flight chamber connected to the wind tunnel system such that the wind tunnel system and the flight chamber allow for a continuous flow of circulating air, and a cooling system for cooling of the air circulating in the wind tunnel system, wherein the cooling system comprises:

an air inlet sucking in a part of the air circulating in the wind tunnel system; and at least one heat exchanger comprising a coolant; and at least one air outlet adapted such that the cooled air leaves the cooling system through the at least one air outlet;

characterized in that the cooling system further comprises:

a closed pressure chamber comprising a cooling area, wherein pressure in said cooling area is higher than atmospheric pressure, and at least one auxiliary fan configured to maintain pressure within the cooling area of the pressure chamber higher than the atmospheric pressure, and in that the at least one heat exchanger is located inside of the closed pressure chamber so that the cooling of the circulating air takes place in the cooling area.

2. The free fall simulator according to claim 1, wherein the air cooled in the heat exchanger leaves the heat exchanger in the direction towards the inside of the cooling area.

3. The free fall simulator according claim 1, wherein the closed pressure chamber comprises at least one intake window and at least one air outlet arranged such that the air inlet is located inside the intake window, and such that the cooled air leaves the cooling area through the air outlet.

4. The free fall simulator according to claim 3, wherein the outlet of the heat exchanger is arranged such that the cooled air from the heat exchanger is outputted towards one of the walls of the pressure chamber, wherein neither of said wall towards which the cooled air is outputted comprises an air outlet.

5. The free fall simulator according to claim 3, wherein the air outlet is an elongated slot that extends across one of the walls of the pressure chamber, and across the entire width of the wind tunnel system.

6. The free fall simulator according to claim 3, wherein the air outlet has an aerodynamic shape adapted to direct the cooled air in a predetermined direction.

7. The free fall simulator according to claim 1, wherein the temperature of the air circulating in the wind tunnel system and in the flight chamber is regulated by means of a closed cooling system.

8. The free fall simulator according to claim 1, wherein the wind tunnel system and the flight chamber form a cyclic wind tunnel, wherein the wind tunnel system includes a diffuser, an upper horizontal section, at least one vertical section, a lower horizontal section, and a nozzle, wherein the cooling system is located in the lower horizontal section of the free fall simulator.

9. The free fall simulator according to claim 1, wherein the wind tunnel system comprises at least one loop having at least one fan, and wherein the cooling system is located behind said at least one fan in the direction of the circulating air.

10. A method of using of the free fall simulator according to claim 1 for supplying heat to a building, wherein the temperature of the air circulating in the wind tunnel system and in the flight chamber is regulated by means of a closed cooling system.

* * * * *